US009475287B2

(12) United States Patent
Bonneton

(10) Patent No.: US 9,475,287 B2
(45) Date of Patent: Oct. 25, 2016

(54) BINARY CONTINUOUS INK JET PRINTER

(75) Inventor: Damien Bonneton, Hostun (FR)

(73) Assignee: Markem-Image Holding, Bourg-les-Valence (FR)

( * ) Notice: Subject to any disclaimer, the term of this patent is extended or adjusted under 35 U.S.C. 154(b) by 140 days.

(21) Appl. No.: 14/118,890

(22) PCT Filed: May 25, 2012

(86) PCT No.: PCT/EP2012/059839

§ 371 (c)(1),
(2), (4) Date: Feb. 17, 2014

(87) PCT Pub. No.: WO2012/163830

PCT Pub. Date: Dec. 6, 2012

(65) Prior Publication Data

US 2014/0168322 A1 Jun. 19, 2014

Related U.S. Application Data

(60) Provisional application No. 61/504,903, filed on Jul. 6, 2011.

(30) Foreign Application Priority Data

May 27, 2011 (FR) ..... 11 54652

(51) Int. Cl.
*B41J 2/105* (2006.01)
*B41J 2/02* (2006.01)
(Continued)

(52) U.S. Cl.
CPC *B41J 2/105* (2013.01); *B41J 2/02* (2013.01); *B41J 2/03* (2013.01); *B41J 2/2128* (2013.01); *B41J 2002/022* (2013.01); *B41J 2002/033* (2013.01)

(58) Field of Classification Search
CPC ..... B41J 2/02; B41J 2/03; B41J 2/105; B41J 2/2128; B41J 2002/022; B41J 2002/033
USPC ..... 347/82, 73, 74, 76, 77, 78, 79, 80, 81, 347/90, 36
See application file for complete search history.

(56) References Cited

U.S. PATENT DOCUMENTS 3,373,437 A 3/1968 Sweet et al.
3,656,171 A * 4/1972 Robertson ..... 347/76
(Continued)

FOREIGN PATENT DOCUMENTS

EP 1 277 580 A1 1/2003
FR 2 906 755 4/2008
(Continued)

OTHER PUBLICATIONS

French Preliminary Search Report issued Jan. 20, 2012, in French Application No. 1 154 652.
(Continued)

*Primary Examiner* — Stephen Meier
*Assistant Examiner* — Alexander D Shenderov
(74) *Attorney, Agent, or Firm* — Miles & Stockbridge P.C.

(57) ABSTRACT

A printing control method of a multi-nozzle binary continuous ink jet printer wherein drops of a first category and drops of a second category are formed by jet breaking. The flowpaths followed by the drops of the first and second categories are differentiated. For printing a black pixel followed by a white pixel, a drop of the first category and a drop of the second category are formed. The cumulative formation time drops of the first and second categories is equal to or higher than the running time of one pixel.

28 Claims, 3 Drawing Sheets

(51) Int. Cl.
*B41J 2/03* (2006.01)
*B41J 2/21* (2006.01)

(56) References Cited

U.S. PATENT DOCUMENTS

| | | | | | |
|---|---|---|---|---|---|
| 3,769,630 | A * | 10/1973 | Hill et al. | 347/80 |
| 3,878,519 | A * | 4/1975 | Eaton | 347/75 |
| 3,947,851 | A * | 3/1976 | Chen et al. | 347/76 |
| 3,999,188 | A * | 12/1976 | Yamada | 347/80 |
| 4,068,241 | A * | 1/1978 | Yamada | 347/75 |
| 4,086,601 | A * | 4/1978 | Fillmore et al. | 347/76 |
| 4,217,595 | A * | 8/1980 | Horike et al. | 347/80 |
| 4,231,047 | A * | 10/1980 | Iwasaki et al. | 347/75 |
| 4,350,986 | A * | 9/1982 | Yamada | 347/75 |
| 4,435,720 | A * | 3/1984 | Horike et al. | 347/6 |
| 4,613,871 | A | 9/1986 | Katerberg | |
| 4,636,808 | A | 1/1987 | Herron | |
| 4,730,197 | A | 3/1988 | Raman et al. | |
| 5,049,899 | A * | 9/1991 | Dunand et al. | 347/75 |
| 6,273,559 | B1 * | 8/2001 | Vago et al. | 347/74 |
| 6,364,470 | B1 * | 4/2002 | Cabal et al. | 347/82 |
| 6,450,628 | B1 * | 9/2002 | Jeanmaire et al. | 347/75 |
| 6,746,108 | B1 * | 6/2004 | Jeanmaire | 347/82 |
| 7,192,121 | B2 * | 3/2007 | Barbet et al. | 347/55 |
| 8,162,450 | B2 | 4/2012 | Barbet | |
| 8,382,258 | B2 * | 2/2013 | Xie et al. | 347/73 |
| 8,382,259 | B2 * | 2/2013 | Panchawagh et al. | 347/76 |
| 2002/0171716 | A1 * | 11/2002 | Jeanmaire | 347/74 |
| 2003/0016275 | A1 * | 1/2003 | Jeanmaire | B41J 2/03 347/74 |
| 2003/0063166 | A1 * | 4/2003 | Jeanmaire | B41J 2/03 347/77 |
| 2003/0193551 | A1 | 10/2003 | Jeanmaire | |
| 2008/0143766 | A1 | 6/2008 | Hawkins et al. | |
| 2008/0231669 | A1 | 9/2008 | Brost | |
| 2009/0153627 | A1 * | 6/2009 | Barbet | 347/76 |
| 2010/0033543 | A1 * | 2/2010 | Piatt et al. | 347/77 |
| 2010/0045753 | A1 | 2/2010 | Barbet | |
| 2011/0109677 | A1 | 5/2011 | Montz et al. | |
| 2012/0026260 | A1 * | 2/2012 | Gao et al. | 347/90 |
| 2013/0342597 | A1 * | 12/2013 | Panchawagh et al. | 347/10 |

FOREIGN PATENT DOCUMENTS

| | | |
|---|---|---|
| FR | 2 938 207 | 11/2008 |
| RU | 2055319 | 2/1996 |

OTHER PUBLICATIONS

French Preliminary Search Report issued May 7, 2007, in French Application No. 2 906 755.
Office Action issued Jun. 2, 2014, in U.S. Appl. No. 13/983,544.
International Search Report issued Nov. 16, 2012 in International Application No. PCT/EP2012/059839.

* cited by examiner

BINARY CONTINUOUS INK JET PRINTER

TECHNICAL FIELD

This invention relates to binary continuous inkjet printers with print heads provided with a multi-nozzle drop generator.

The invention is directed to a printing control method and a printer or print head of a printer using this method.

PRIOR ART

There are two main categories of continuous jet printers, deflected continuous jet printers and binary continuous jet printers. This invention relates to binary continuous jet printers.

In such a printer, since the jet is continuous, it is necessary to control jet cutting so as to be able to separate the ink required for printing from the ink which is not. Controlling jet breaking enables ink drops to be produced as desired. For each position of the medium, for each nozzle, depending on the pattern to be printed, an ink drop coming from the nozzle should be directed towards the printing medium or conversely towards a recovering gutter.

Different methods are known for performing the selection between drops to be directed to the medium and drops to be directed to the recovering gutter. Two categories of continuous jet printers can be distinguished depending on the way of selecting between printing drops and recovered drops. In a first method, the drops have all substantially the same volumes. In a second method, the drops intended for printing and the drops recovered by the gutter are different from each other with respect to their volumes.

A first example of this first category is described in U.S. Pat. No. 3,373,437 to Sweet et al. Conductive ink drops are evenly formed. The drops, being of the same sizes due to their production mode, are formed at a drop charging electrode. According to the potential applied to the charging electrode at the moment of jet breaking, the drop is electrically charged or uncharged. Deflecting electrodes located downstream of the charging electrodes create an electrostatic field which results in deflecting charged drops whereas uncharged drops are not deflected. This flowpath difference enables to separate the drops intended for printing from drops which are not. In a first alternative embodiment, described for example in U.S. Pat. No. 4,636,808 to Heron, the electrode is both a charging and deflecting electrode. The undeflected drops are used for printing. A known drawback of this method is that it requires a charging electrode for each ejecting nozzle the potential of which should be high or low in synchronism with jet breaking. For that reason, the method according to this first example and its alternative are subject to crosstalks. Crosstalks happened between rows, electrodes of adjacent nozzles or between drops from these nozzles. Drops charged by crosstalks, even though weakly charged, are slightly deflected, which results in printing defects.

To partially make up for printing defects produced by crosstalks from drop to drop, there is provided in a second alternative described in U.S. Pat. No. 4,613,871 to Katerberg, introducing guarding drops between drops intended for printing. The guarding drops and printing drops have the same volumes.

Patent application US 2008/0143766, describes a method for printing a pattern on a medium wherein:

the pass time of a pixel is divided into a plurality of subintervals, and wherein the subintervals are gathered into blocks of subintervals, each block is defined as a printing block or a non-printing block.

A pattern is formed on the medium as the ink emitted during the intervals corresponding to the printing blocks is formed into printing drops and as the ink emitted during the subintervals associated with the non-printing blocks is formed into non-printing drops captured by a gutter.

This method allows for the setting of the grey levels of the pattern to be printed.

The device described in patent application EP 1 277 580 is essentially a device for cleaning a printing head. In the description of the operation of the printer to which the cleaning device is applied, it is mentioned that small drops for printing and large drops recovered by a gutter are formed.

The device described in patent application US 2003/0063166 in particular in paragraphs 40-45 in connection with FIGS. 2 and 3 includes a printing head controlled by a controller. Depending on the white or black colour of the pixel to be printed, pulses of different levels are sent to thermal actuators. The pulses are such that drops 100 having a first rate and drops 95 of the same volume having a second rate lower than that of drops 100 can be produced. On part of their trajectory, the drops undergo a wind transverse to their trajectories. Drops 100 having the highest rate are subjected for less time to the action of wind than drops 95 having the low rate. Hence, drops 100 are less deflected than drops 95. Drops 100 will impact a printing medium W. Drops 95 are recovered by a gutter.

Patent application US 2011/109677 describes a method applicable to a continuous ink jet printer provided with ejecting nozzles. Small printing drops and large non-printing drops are produced. To improve the placement accuracy of the printing drops on the medium with respect to the method described in patent application US 2008/0231669, a phase shift between pulse trains controlling actuators of consecutive nozzles are varied as a function of the medium rate.

DESCRIPTION OF THE INVENTION

This invention originates from a reflection about the printing rate of a continuous jet printer of the second category.

In a printer of the second category where drops are sorted after formation, depending on their volumes, there are drops of the first category, intended for printing. These drops have substantially the same volumes so as to form impacts of the same dimensions onto the medium. By "substantially", it is meant that the volume of these drops has a mean value form which neither of the drops deviates by more than 12%. The jet rate from a nozzle is constant, the formation time of one drop of the first category is different from the formation time of one drop of the second category. For a constant running rate Vs of the medium with respect to the printing head, the running time Dp of all the pixels is the same, whether the pixels are white or black.

The inventors have shown that there is a relationship between the rate of the medium, jet rate, printing resolution, printing drop volume, non-printed drop volume and printing rate.

$$Dp=Dii/Vs=da+kdb=k'db' \quad (1)$$

wherein:

Dii is the distance between centres of consecutives pixels;

Vs is the running rate of the medium with respect to the printing head;

da is the formation time of one drop of the first category intended to form a black pixel;

k is a positive integer equal to or higher than 1;

db is the formation time of at least one drop of the second category formed during the running time dr of a black pixel minus the time da, dr=Dp−da;

k' is a positive integer equal to or higher than 1;

db' is the formation time of at least one drop of the second category formed for printing a white pixel.

This invention enables, for a same rate of jets, to cover a wide range of media rates Vs.

The invention relates to a printing control method for a multi-nozzle binary continuous ink-jet printer or print head of such a printer for printing a pattern on a printing medium moving with respect to the head, the head comprising:

a multi-nozzle drop generator including a body including one or more pressurised chambers each able to receive ink under pressure, ejecting nozzles in hydraulic communication with a pressurised chamber and each able to eject an ink jet having a rate Vj along the longitudinal axis thereof, the nozzles being aligned along an aligning axis and arranged on a same plane, actuators, each able to cause, on pulse order, breaking of a jet ejected from a nozzle to form a succession of drops, the medium having with respect to the head, a rate Vs, the distance between consecutive pixels in the direction of movement of the medium being Dii, wherein:

drops of first category and drops of a second category are formed by jet breaking, the drops of the first category each having a first volume, all the first volumes being substantially equal, the drops of the second category having second volumes not necessarily equal but all the drops of the second category have a volume which is not equal to the volume of a drop of the first category, the flowpaths followed by the drops of the first and second categories are differentiated by applying to at least one of the drop categories a deflection force able to differentiate the flowpaths of drops of the first category and drops of the second category, the flowpath of drops of the first category intersecting the printing medium and the flowpath of drops of the second category intersecting a gutter for recovering such drops, a piece of information relating to moments where consecutive pixels to be printed run in a position where they are likely to be printed is created, for printing each black pixel of the pattern (or a black pixel) which is followed by a white pixel, one drop of the first category and one drop of the second category are formed, the cumulative time for forming such drops of the first and second categories being equal to or higher than the running time of one pixel.

It is set out herein that the piece of information relating to moments when the consecutive pixels to be printed run in a position where they are likely to be printed, is generally provided by printing medium advancement measuring means. These measuring means are coupled to the printing control means. They inform the control means about moments of transition between a current pixel and the next consecutive pixel. The piece of information is generally transmitted as electrical, optical or magnetic pulses, transmitted each time the medium has advanced by a distance of one pixel or a fraction of one pixel. These pulses are also called "cues".

In the following, drops of the first category are of a smaller volume than drops of the second category. All than can be said in the following is also applicable to the opposite case with the proviso to replace "second category" by "first category" in the different sentences and conversely.

According to a first aspect of the invention, to print a black pixel, one drop of the first category and one drop of the second category are formed, the cumulative time for forming the drop of the first category and the drop of the second category being equal to the running time Dp of the medium from the distance Dii.

The embodiment of a black pixel according to this first aspect can be used as long as the remaining running time dr of the pixel is sufficient to form a drop of the second category.

According to a second aspect, to form a white pixel, a drop of the second category is formed the formation time of which is at least equal to the running time of the medium by a distance Dii. The formation time of this drop can be longer than the running time of a pixel if the white pixel is followed by another white pixel.

When the running rate increases, the remaining time dr after formation of one drop of the first category decreases. For high rates, the time dr can become insufficient to form one drop of the second category. In this case, according to a third aspect, prior to printing a current pixel, it is examined whether the following pixel is a white or black pixel.

If the current pixel is black and the following pixel is white, one drop of the first category is formed for printing the current pixel, and then one drop of the second category is formed, the formation time of these drops of the first and second categories being equal to at least twice the running time Dp of a pixel. This time can be greater if the white pixel is followed by another white pixel. It will be noted that in this case, the cumulative formation time of drops of the first and second categories is longer than the running time of one pixel.

If the current pixel is a black pixel and the following pixel is also a black pixel, drops of the first category are formed for at time equal to the running time of the current black pixel, plus a time between 1 and 2 times the formation time da of one drop of the first category.

BRIEF DESCRIPTION OF THE FIGURES

Other advantages and characteristics of the invention will appear more clearly upon reading the detailed description made in reference to the following figures wherein.

Elements having similar functions in FIGS. 1 to 3 are given the same reference numeral.

DETAILED DESCRIPTION OF PARTICULAR EMBODIMENTS

Figure 1:
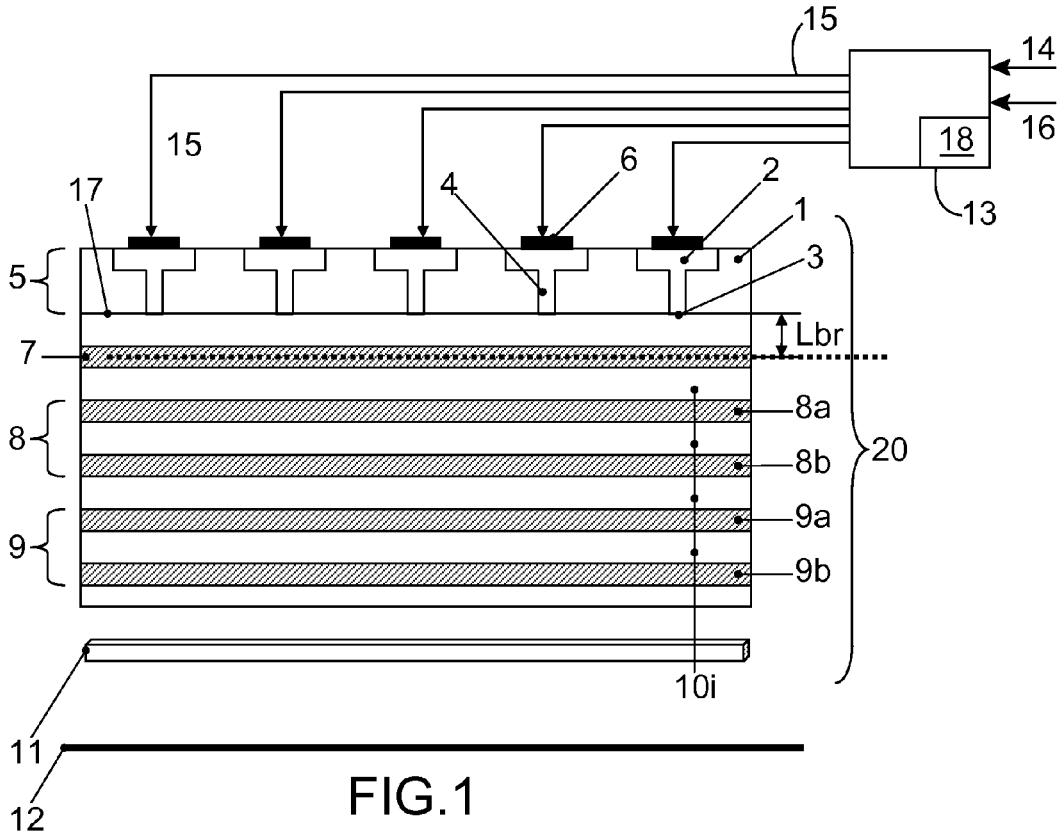
FIG. 1 is a longitudinal schematic cross-section view of a portion of a printing head of one exemplary embodiment of a continuous jet printer of the second category that can be driven according to the method of the invention.
Figure 2:
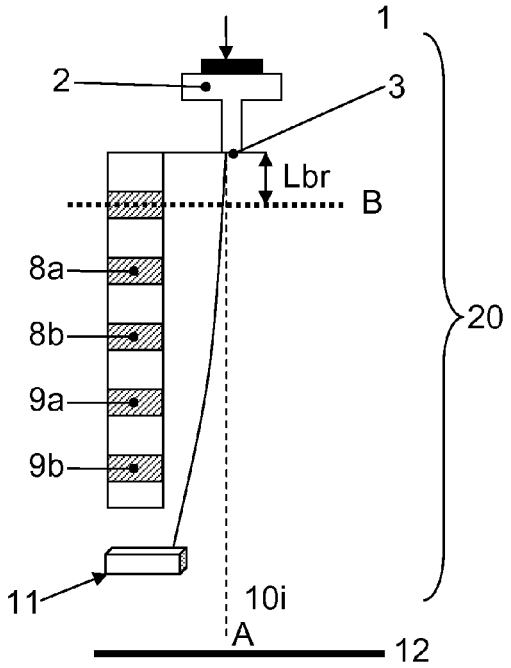
FIG. 2 is a transverse schematic cross-section view of the printing head according to FIG. 1.

It is represented in FIGS. 1 and 2 one exemplary printing head 20 of a continuous jet printer of the second category that can be driven according to the method of the invention. Such a printer is described in patent application US 2010/0045753 on behalf of the applicant, which is incorporated here in reference. For details about the implementation, this application may be referred to.

The head comprises a so-called multi-nozzle generator 5 with a body 1, including one or more rows of pressurised stimulation chambers 2. For more details about the multi-nozzle drop generator 5, U.S. Pat. No. 4,730,197, for example, may be referred to. For details relating to ink supplies, ink tank and restrictions, explanations given in U.S. Pat. No. 7,192,121 may be referred to.

Each pressurised stimulation chamber 2 is in hydraulic communication with a nozzle 3 via a conduit 4. All the nozzles 3 are aligned along an aligning axis and they are arranged in a same plane 17. These nozzles 3 are generally made in a plate usually called nozzle plate and the underneath surface of which is the plane 17.

Actuators 6 are each mechanically coupled to one of the pressurised chambers 2. The actuators 6 are each electrically coupled or connected to printing control means 13, for example as represented in FIG. 1, by a line 15. The body 1 and the actuators 6 together form the multi-nozzle drop generator 5.

The control means 13 receive as an input data 16 about the relative position between the printing head 20 and printing medium 12 and information 14 about the pattern to be printed represented by arrows on the figures. As set out above, the data 16 are one piece of information from which the control means 13 are informed about the beginning and the end of running of one pixel.

The control means 13 includes one or more microprocessors and memories 18. The memories 18 contain a printing driving software and data 14 relating to the pattern to be printed. The control means 13 control sending pulses for jet breaking to each actuator 6.

The printing head 20 further includes a set of electrodes arranged downstream of the multi-nozzle drop generator 5 and laterally offset with respect to the plane containing the axes A of the nozzles 3. This set first comprises a first electrode 7 immediately downstream of the nozzles 3. This electrode is called shielding electrode 7 because it is at the same electrical potential as the ink present in the pressurised stimulation chamber 2. The chamber is called stimulation chamber because jet breaking is achieved through creating by means of an actuator 6 a pressure wave which propagates to the jet through the chamber. Downstream of the shielding electrode 7, is arranged at least one pair of electrodes. The example shown includes two pairs of deflecting electrodes 8, 9 the most upstream of which includes two electrodes 8*a*, 8*b* and the most downstream 9 of which includes electrodes 9*a*, 9*b*. The electrodes 8*a*, 8*b* or 9*a*, 9*b* of a same pair are preferably powered in opposite phase by an AC voltage.

A dielectric layer 10*i* is present between two consecutive electrodes 7, 8*a*, 8*b*, 9*a*, 9*b*.

Finally, a recovery gutter 11 for the ink not used for printing is arranged downstream of all the electrodes 7, 8*a*, 8*b*, 9*a*, 9*b*.

The body 1, the actuators 6 and means thereof for coupling and connecting to control means 13, the shielding electrode 7, the deflecting electrodes 8*a*, 8*b*, 9*a*, 9*b*, the dielectrics 10*i*, the ink recovery gutter 11 together form the printing head 20.

Another printer that can make use of the control method according to the invention will now be described in relation to FIG. 3.

Figure 3:
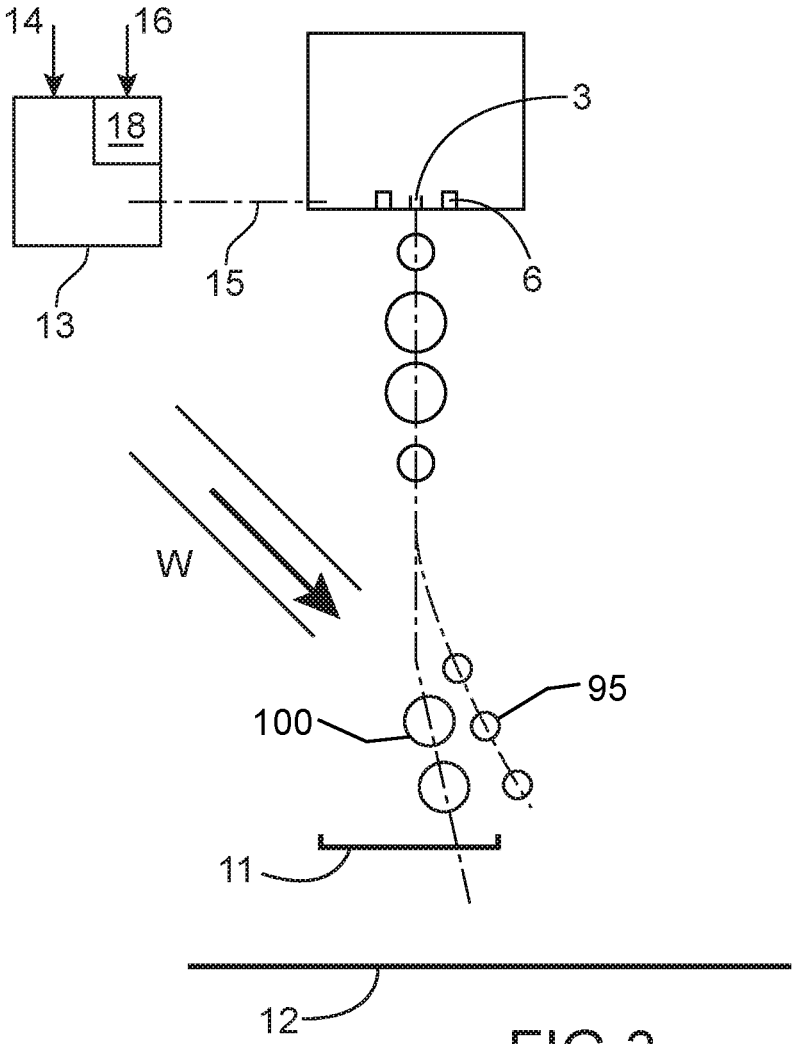
FIG. 3 is a transverse cross-section view of a printing head of another exemplary embodiment of a continuous jet printer of the second category that can be driven according to the method of the invention.

The printer described in relation with FIG. 3 is described in patent application US 2003/0193551 to Jeanmaire et al. which may be referred to for more details. This application is incorporated in reference.

The printing head 20 of this printer differs from the printing head described in relation to FIGS. 1 and 2 essentially by the means for differentiating flowpaths of drops of the first and second categories and by the drop generation mode. The printing head described in relation to FIG. 3 does not include the set of electrodes 7, 8*a*, 8*b*; 9*a*, 9*b*.

This set is replaced by a conduit W wherein a wind is blown. This wind is the means for differentiating flowpaths of drops of the first and second categories. While in the example represented in FIGS. 1 and 2, there is a chamber pressurised by one nozzle 3, in the example of FIG. 3, there can be several nozzles 3 in communication with a single pressurised chamber 2. The actuators 6 of the example of FIG. 3 are positioned in the vicinity of each nozzle. Thus, the actuators 6 act more directly on jets to cause, on order, breaking thereof, and not as in the example represented in FIGS. 1 and 2 by creating a pressure wave propagating from the chamber to the jet.

As represented in FIGS. 1 and 3, the control means 13 of the actuators 6 can also be incorporated to the printing head 20, partially or completely or simply be electrically coupled, for example through a cable to this head.

The operation of a printing head as described in relation with FIGS. 1 and 2 or 3 is the following.

The printing head 20 and a printing medium 12 are moving with respect to each other. Jet breakings for forming drops are obtained by sending pulses to the actuators 6. The volume of a drop in the case of the printer represented in FIGS. 1 and 2 is determined by the time between consecutive pulses, all of the same energy, applied to a same actuator 6. The breaking always occurs at an axis B a distance Lbr from the plane 17 of the nozzles. The axis B is between the most upstream part and the most downstream part of the shielding electrode 7. A drop of the first category is obtained by sending to a same actuator 6 two consecutive pulses spaced apart by a small duration.

The duration should be small enough for the most downstream part of the jet section which is formed from the moment of breaking due to the first pulse to be upstream of the dielectric layer 10*i* separating the shielding electrode 7 from the first deflecting electrode 8*a*. These drops are thus formed at a point where the jet part which will make them after the breaking due to the second pulse has not undergone any electrostatic influence from the deflecting electrodes 8*a*, 8*b*; 9*a*, 9*b*. Therefore, the flowpath of these drops is undeflected by the deflecting electrodes 8, 9. These non-deflected drops will come and impact the printing medium 12. When the duration between two consecutive pulses applied to a same actuator is longer than the formation time of one drop of the first category and sufficient to form one drop of the second category, the drop of the second category is deflected due to the electrostatic force exerted on it by at least one of the deflecting electrode 8*a*, 8*b*; 9*a*, 9*b*.

In the printer described in relation with FIG. 3, one drop of the first or second category is emitted as a function of the energy of one pulse transmitted from the control means 13 to an actuator 6.

The wind W arrives transversal to the flowpath of the drops and deflects more drops of the first category than more voluminous drops of the second category. Drops of the second category, the flowpath of which is not much deflected, are recovered by the gutter 11, and drops of the first category the flowpath of which is more deflected will impact a medium 12. In this exemplary embodiment, drops of the first category are also of a smaller volume than drops of the second category, but they are the most deflected drops.

In the case of printers described in relation to FIGS. 1 and 2 or 3, position cues 16 of the medium 12 with respect to the printing head 20 are received by the control means 13. Depending on the resolution, the control means 13 count a number of cues 16 which separate the beginning and end times of the passage of one current pixel in a position where the nozzles can print this current pixel and consequently form pixel beginning and end cues.

Embodiments of the invention will now be described. Generally, the control method according to the invention is applicable to any binary continuous jet printer wherein a differentiated deflection of the flowpath of drops as a function of volumes thereof occurs. These embodiments are therefore applicable in particular to printers described in relation to FIGS. 1 and 2 or 3.

A first embodiment can be used as long as the relative rate of the medium and that of the printing head is lower than a value Vs0. For the value Vs0, Dp=Dii/Vs0 is equal to (1+Rm)da, wherein equation Rm stands for the minimum value which should be assumed by the ratio R of the volume of one drop of the second category to the volume of one drop of the first category so that flowpaths of drops of the first and second categories are markedly differentiated in view of the separation mode of flowpaths. For running rates of the medium higher than Vs0, a second embodiment of the invention is used. This second embodiment can also be used for rates lower than Vs0.

The first embodiment will now be described in relation with FIG. 4. This figure represents on a time axis X placed horizontally, running times for consecutive pixels. Separations between consecutive pixels are represented by vertical lines. There is shown consecutively a black pixel N, two white pixels B, and then two black pixels N. There is shown on this same axis X the formation times da of drops "a" of the first category and db, db' of drops b and b' of the second category respectively. Drops b are the ones formed during the running time dr=Dp−da, in the course of printing one black pixel. Drops b' are the ones formed for the running time Dp of one pixel, in the course of printing one white pixel.

In the first embodiment, black pixels are all formed identically. White pixels are also formed identically. It will therefore only be described for this embodiment the formation of a black pixel and the formation of a white pixel.

To form a black pixel, the control means 13 control sending of one drop of the first category, a, the formation time da of which is represented by a jet portion on the axis X. Then, they control the formation of one drop of the second category the time dr=db of which is represented by a jet portion of the axis X. To form a white pixel, one drop of the second category b' is formed, for at least the entire duration of a white pixel. In the example shown in FIG. 4, the formation time db of the drop b is 4 times higher than the formation time da of a drop a. The running time of a pixel is thus equal to 5 times the formation time da of a drop a. The running time Vs5 is such that Dii/Vs5=5da.

When the running rate increases, the time da for forming drops of the first category remains the same since these drops should have the same volume to form impacts equal to each other the diameter of which is a function of the medium nature but remains between 1 and 1.5 times the distance Dii. On the other hand, the allocated times db and db' to form drops b and b' respectively of the second category decrease so that the volume of these drops becomes smaller.

Figure 4:
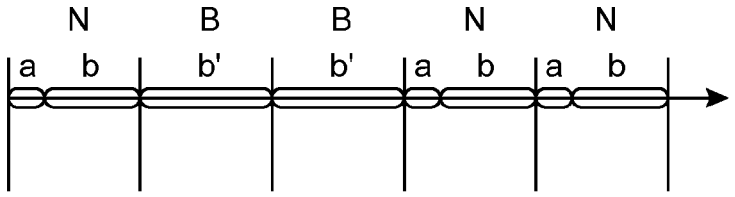
FIG. 4 represents an exemplary time chart of the formation of drops of the first and second categories for a succession of one black pixel, two white pixels, and then two black pixels.
Figure 5:
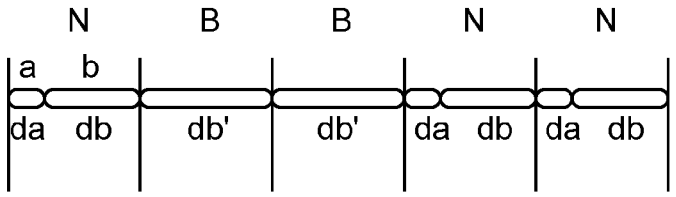
FIG. 5 represents another exemplary time chart of the formation of drops of the first and second categories for the same succession of pixels as that of FIG. 4 but with a running rate of the medium twice as high as the case of FIG. 4.

FIG. 5 illustrates the same succession of pixels as the one represented in FIG. 4. The time scale and the representation mode of drops of the first and second categories are also the same. In the illustration of FIG. 5, the running rate Vs25, is twice the running rate Vs5 of FIG. 5. For that reason, the running time of one pixel is twice as small.

In the representation of FIG. 5, the first operating mode has been retained. The running time of one pixel is equal to 2.5 times the formation time of one drop a. After forming a drop a with a time da for forming a black pixel, the time dr for forming the drop of the second category is 1.5 times the formation time da of one drop a. As compared with FIG. 5, the formation times db and db' of drops of the second category for black and white pixels respectively are decreased so that the succession of pixels is printed twice faster.

Figure 7:
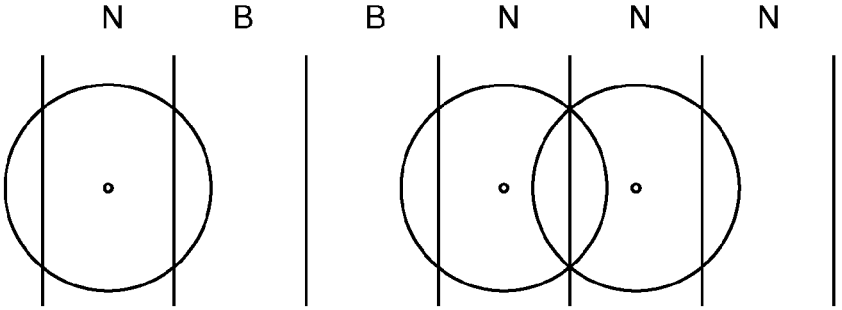
FIG. 7 represents impacts of drops of the first category represented in FIG. 4 or 5 on a printing medium.
Figure 8:
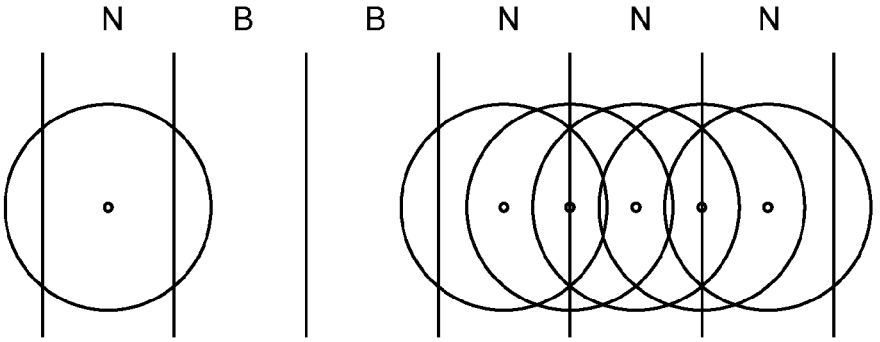
FIG. 8 represents impacts of drops of the first category represented over the cross of time in FIG. 6.

FIG. 7 represents, on the printing medium 12, the succession of impacts of drops. In the cases represented in FIGS. 4 and 5, these impacts are represented in the same figure because they have the same configuration. Each impact is represented by a circle centred at the centre of one pixel when this pixel is a black pixel. As long as the first embodiment is performed, impacts of printing drops are the ones provided by the pattern regardless of the moving rate Vs of the medium 12.

Depending on the separation mode of flowpaths of drops of the first and second categories, the ratio R=1.5 of the volumes of drops of the second category b to first category a can be higher or lower than Rm. In the case where this ratio is equal to or higher than Rm, the first mode can, according to the invention, be used, as represented in FIG. 5. The second mode which will now be described can also be used. However, if the ratio dr/da=R is lower than Rm, using the second mode becomes imperative.

Figure 6:
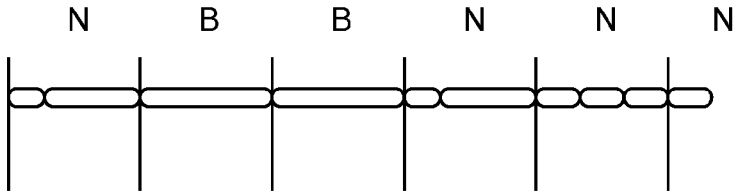
FIG. 6 represents an exemplary time chart of the formation of drops of the first and second categories for a succession of one black pixel, two white pixels, and then three black pixels.

The formation times of drops are illustrated in FIG. 6 with the second operating mode.

In the second operating mode, before printing a current pixel, the nature of the next pixel, whether white or black, is examined.

If the current pixel is black, and the following is also black, according to a first alternative embodiment of this second mode, drops of the first category are formed during the running time Dp of the current pixel, plus a time between 1 and twice the formation time da of one drop of the first category.

For a succession of n consecutive black pixels, let us set $$(n-1)Dp/da=(q-\delta) \quad (1).$$

In the formula (1):

q designates the higher integer closest to (n−1)Dp/da;

δ represents the fraction to be added (n−1)Dp/da to result in q. δ is thus between 0 and 1. n is an integer equal to or higher than 2.

In the course of running n consecutive current black pixels, (q−1) drops a are formed, and forming a qth drop a is begun. This qth drop a is called a transition drop because the cue showing the end of the black pixel with a rank n−1 is received in the course of formation thereof. At the end of the formation of the transition drop, a last drop will again be formed for printing the next consecutive black pixel. It will thus be seen that the formation time of the drops a, for n consecutive black pixels is equal to the duration (n−1)Dp plus a duration (2−δ)da, that is ((n−1)Dp+(2−δ)da). The number of drops formed for this duration is equal to:

$$(n-1)Dp/da+Dp/da+\delta Dp/da=(q+1)Dp/da \quad (2)$$

In the example represented in FIG. 6, for two consecutive pixels, 2.5 drops are formed for the duration of the first pixel, the formation of transition drop is terminated between the first and the second pixels and a drop is added. In total, 4 drops are formed. By applying formula (2), there is obtained Dp/da=2.5, q=3, δ=0.5. If, as represented in FIG. 6, there is a third black pixel consecutive to two black pixels, a series of drops of the first category is formed, for a duration 2dp that is 5 drops+1. In this case, q=5, δ=0. 6 drops were formed during the running time of the three pixels and the sixth and last drop a is well placed because there is no transition drop.

In the case represented in FIG. 6, it has been seen that the end of running the second black pixel does not coincide with the end of forming a drop a. Whether the formation of drops a is stopped, after the drop a being formed at the moment of receiving the piece of information about the passage from the current black pixel to the following black pixel, or another drop is formed after this one, the next black pixel is badly positioned. A set of discrete values of running rates Vs may be retained for the operation in this second mode. Only included in this set are running rates Vsp of the medium such that the running time Dp of one pixel is equal to an integer p of formation times da of drops a. Vsp=Dii/pda.

In the second operating mode, if the current pixel is a black pixel and the next pixel is a white pixel, one drop of the fist category is formed to form the black pixel, and the formation of one drop of the second category is begun without being discontinued at the time of transition between the black pixel and the white pixel. To form one drop of the second category, there is thus provided the duration beginning at the end of the formation of the drop of the first category forming the black pixel, and ending at the end of running of the white pixel following the black pixel.

The upper limit of the running rate Vs in operating in this second mode is reached when the volume ratio between drops of second and first categories (dr+Dp)/da becomes equal to or lower than Rm.

By using the second embodiment, the range of running rate Vs is increased since the upper limit changes from a rate for which dr/da=Rm to a rate for which (dr/da+Dp/da)=Rm.

When a print is begun, the medium 12 is moved with respect to the printing head. When the medium reaches a minimum rate Vsm, the printer is switched on according to the first mode. The first mode can be retained as long as the running rate Vs of the medium is such that dr/da>Rm. For this limit and preferably before this limit is reached, the method proceeds to the second operating mode.

The inventors have noted that, at higher rates Vs, printing faults occur. To make up for these faults, for the direct piece of information of position of the medium, is substituted a substituted piece of information obtained the following way. First, it should be noted that the pulse frequency enabling the moment of transition between consecutive pixels to be determined is the order of 0.8 to 3 hundred kilohertz.

For example, for a rate Vs of 5 m/s and a resolution of 254 dpi, that is 0.1 mm per pixel, a frequency of 300 khz enables to provide six pulses per pixel. The frequency of a reference clock from which are built the clocks necessary to operate control means 13 is in the order of several tens of megahertz, for example 32 MHz.

According to this embodiment of the invention, when the running rate of the medium is higher than a threshold, for a direct piece of information of the position of the medium coming from the medium position measuring means, is substituted a piece of information calculated from the piece of information received by these means. In a detailed manner, a) the instantaneous running time $dp_i$ of one pixel is determined. This time is determined from information coming from the means for measuring the advancement of the printing medium 12. Since drops a have always the same formation time, the number of reference clock periods having to be counted to obtain this time is known.

b) The number of periods of the reference clock necessary for obtaining the time da and the instantaneous times $dp_i$ and $dr_i$ is determined.

c) From the times thus determined, a reconstituted piece of information about the running of the pixels, for example as pulses, is formed.

d) The piece of information thus created is used for controlling jet breakings.

e) The reconstituted piece of information of the pixels is used until the next determination of the instantaneous time $dp_i$ of running one pixel.

f) Steps a) to e) are periodically repeated.

A substituted piece of position information calculated from the measured piece of position information is preferably used as long as the medium rate is higher than a threshold, regardless of whether the printer operates according to the first or the second mode. The inventors believe that because a clock is used rather than the direct piece of information coming from the means for measuring the position of the medium 12, inconveniences due to vibrations from the medium are avoided.

The printer according to the invention is frequently used for printing a succession of entire patterns. An entire pattern is for example a short message to be printed on packages which run in front of the printing head. The pattern includes for example a nomenclature, a date, a passage time, or other information relating to the identity or traceability of the packaged object. In this case, the control means 13 construct a piece of information about a pattern printing end and a next pattern printing beginning. The time $dp_i$ is determined before each printing of an entire pattern and this time is retained throughout the printing time of the next pattern. The inventors have observed that the printing result obtained is better with this method.

It has been seen above that in the second operating mode, it is preferable for a good positioning of the drop forming the last black pixel of a series of black pixels, that the time Dp be equal to an integer of times the time da.

Depending on the value of z, it will be chosen to form k drops of a formation time da' greater than the time da or (k+1) drops with a formation time smaller than the time da.

There as either $$Dp=(k+z)da=kda' \text{ with } da'=(k+z)da/k$$

or $$Dp=(k+z)da=(k+1)da'' \text{ with } da''=(k+z)da/(k+1).$$

It will be chosen to produce k or (k+1) drops so as to minimise the absolute value of the deviation percentage between da' and da" respectively with respect to da.

When the running rate of the medium varies while being printed to change from a first constant rate to a second constant rate, the running rate Vs will necessarily have values for which the time Dp is not equal to an integer times the time da. Thus, according to an alternative embodiment of the second embodiment, the formation time da' of drops a of the first category is varied so that the ratio Dp/da' remains as close to an integer as possible. Let us consider an example wherein the rate Vs decreases between two values, that is a first value $Vs_k$ and a second value $Vs_{k+1}$. At the end values of this variation range, the time Dp is equal to kda and (k+1)da respectively.

Between both values, the time is (k+z)da. z is an number which, during the rate transition, ranges between 0 and 1. At the beginning of the transition, k drops will be continued to be formed per pixel, but these drops will have a greater formation time $da'=(k+z_1)/k$. From the moment when z is greater than $z_1$, (k+1) drops will be formed per pixel but these drops will have a smaller formation time than the rated value da that is $da''=da(k+z_1)/(k+1)$. The $z_1$ value of z is preferably that for which the absolute deviation to 1 of the ratio $(k+z_1)/(k+1)$ is equal to the absolute deviation to 1 of the ratio $(k+z_1)/k$. Of course, if as a result of the rate variation, k varies by more than one unit, the same operation is made each time k changes to a value k+1 or in case the medium 12 speeds up from a value k to the value k−1.

For example, at the beginning of the rate transition for which Dp=5da to a rate for which Dp=6da, 5 drops will be continued to be formed per pixel at the beginning of the transition but these drops will have a greater volume than the rated volume da of one drop of the first category da'=5.45/5 that is 1.09da, from the rate for which $z_1$=5.45, six drops will be formed but these drops will have a smaller volume than the rated volume da, that is da'=5.45da/6=0.91da.

Thus, with a maximum deviation of the volume of drops of the first category of 15% around the rated value, positioning faults are minimised.

Preferably, when the running time of one pixel is not equal to an integer times the time da, the substituted piece of position information such as defined above to control jet breakings is used.

The invention claimed is:

1. A printing control method for a multi-nozzle binary continuous ink-jet printer or print head of such a printer for printing a pattern on a printing medium moving with respect to the head, the method comprising:

providing a head comprising a multi-nozzle drop generator including a body including one or more pressurised chambers each able to receive ink under pressure, ejecting nozzles in hydraulic communication with a pressurised chamber and each able to eject an ink jet having a rate Vj along a longitudinal axis (A) thereof, the ejecting nozzles being aligned along an aligning axis and arranged on a same plane, a plurality of actuators configured to cause, on pulse order, breaking of a jet ejected from a nozzle to form a succession of drops, the medium having with respect to the head, a rate Vs, the distance between consecutive pixels in the direction of movement of the medium being Dii;

forming drops of a first category and drops of a second category by jet breaking, the drops of the first category each having a first volume, all the first volumes being substantially equal, the drops of the second category having second volumes not necessarily equal but all the drops of the second category having a volume which is not equal to the volume of a drop of the first category;

differentiating the flowpaths followed by the drops of the first and second categories by applying to at least one of the drop categories a deflection force able to differentiate the flowpaths of drops of the first category and drops of the second category, the flowpath of drops of the first category intersecting the printing medium and the flowpath of drops of the second category intersecting a gutter for recovering such drops;

creating a piece of information relating to moments where consecutive pixels to be printed run in a position where they are likely to be printed; and for printing each black pixel of the pattern which is followed by a white pixel of the pattern, forming one single drop of the first category and one single drop of the second category, wherein a time for forming one of said drops is less than a running time of one pixel and a cumulative time for forming said single drops of the first and second categories is equal to or higher than a running time of one pixel.

2. The printing method according to claim 1, wherein, for printing each black pixel of the pattern, said one single drop of the first category and said one single drop of the second category are formed, the cumulative time for forming the drop of the first category and the drop of the second category being equal to a running time Dp of the medium by the distance Dii.

3. The printing method according to claim 1, wherein for forming each white pixel of the pattern, one single drop of the second category is formed, the formation time thereof being at least equal to a running time Dp of the medium by a distance Dii.

4. The printing method according to claim 1, further comprising:

wherein, before printing a current pixel of the pattern, determining whether a following pixel is a white or black pixel, and if the current pixel is black and the following pixel is white, forming a single drop of the first category for printing the current pixel, and then forming a single drop of the second category, the formation time of said single drops of the first and second categories being at least equal to twice the running time of one pixel.

5. The printing method according to claim 4, wherein the rate Vs is a running rate selected so that the running time Dp of one pixel is equal to pda, p standing for an integer and da standing for the formation time of one drop of the first category.

6. The printing method according to claim 1, wherein for printing each succession of n consecutive black pixels of the pattern, n standing for an integer equal to or higher than 2, drops of the first category are formed for a time equal to the running time of (n−1) black pixels plus a time between 1 and 2 times the formation time of one single drop of the first category.

7. The printing method according to claim 1, further comprising:

for printing each black pixel of the pattern, forming one single drop of the first category and one single drop of the second category, the cumulative time for forming the single drop of the first category and the single drop of the second category being equal to a running time Dp of the medium by the distance Dii, as long as the relative rate of the medium and the printing head, rate Vs, is lower than a value Vs0, or determining, before printing a current pixel of the pattern, whether a following pixel is a white or black pixel, and if the current pixel is black and the following pixel is white, forming a single drop of the first category for printing the current pixel, and then forming a single drop of the second category, the formation time of said single drops of the first and second categories being at least equal to twice the running time of one pixel, as long as the relative rate of the medium and the printing head Vs is higher than a value Vs0.

8. The printing method according to claim 7, wherein the value Vs0 is the rate for which Dp=Dii/Vs0 is equal to (1+Rm)da, in which formula Dp stands for the running time by the distance Dii for the rate Vs0, da stands for the formation time of one drop of the first category, Rm stands for the minimum value which should be assumed by the ratio R of the volume of a drop of the second category to the volume of a drop of the first category so that the flowpaths of drops of the first and second categories are markedly differentiated in view of a separation mode of flowpaths.

9. The printing method according to claim 1, wherein, when the running rate of the medium is higher than a threshold, positional information of the medium from medium position measuring means is substituted by information calculated from information received by these means.

10. The printing method according to claim 9, wherein the substituted information is recalculated after each printing of an entire pattern.

11. The printing method according to claim 1, wherein, when the rate Vs is a running rate such that a running time Dp of one pixel is determined by taking a value between two integers times k and k+1, where k is a number of drops, of a formation time, da, of one drop of the first category, said formation time da is changed to a different formation time, da', such that the running time Dp is equal to k*da' or (k+1)*da'.

12. The printing method according to claim 11, wherein, when the running rate Vs of the medium ranges between a first rate $Vs_k$ and a second rate $Vs_{k+1}$ for which the running time Dp is equal to kda and (k+1)da, respectively, and is equal to (k+z)da within the range of these two values, z being a number ranging from 0 to 1, the formation time of drops is increased as long as z is lower than a value $z_1$ and forming k drops having a formation time da'=da(k+$z_1$)/(k+1) per pixel is continued, and when z is equal to or higher than the value $z_1$, k+1 drops having a formation time da"=da(k+$z_1$)/(k+1) per pixel are formed.

13. The printing method according to claim 1, wherein the formation time of drops is determined either by a time of a deviation bet en two consecutive pulses received by the actuators, or by energy level of one pulse received by the actuators.

14. The printing method according to claim 1, wherein differentiating the flowpaths followed by single drops of the first and second categories respectively is achieved either by applying an electrostatic force to drops of the second category, or by applying to drops of the first and second categories a wind (W) with a direction transverse to the flowpath of the drops.

15. A printer or printing head comprising:

ahead comprising a multi-nozzle drop generator including;

a body including;

one or more pressurised chambers each able to receive ink under pressure;

ejecting nozzles in hydraulic communication with a pressurised chamber and each able to eject an ink jet having a rate Vj along a longitudinal axis (A) thereof, the ejecting nozzles being aligned along an aligning axis and arranged on a same plane; and a plurality of actuators configured to cause, on pulse order, breaking of a jet ejected from a nozzle to form a succession of drops, wherein the head is configured to form drops of a first category and drops of a second category by jet breaking, the drops of the first category each having a first volume, all the first volumes being substantially equal, the drops of the second category having second volumes not necessarily equal but all the drops of the second category having a volume which is not equal to the volume of a drop of the first category;

differentiate flowpaths followed by the drops of the first and second categories by applying to at least one of the drop categories a deflection force able to differentiate the flowpaths of drops of the first category and drops of the second category, the flowpath of drops of the first category intersecting a printing medium and the flowpath of drops of the second category intersecting a gutter for recovering such drops;

create information relating to moments where consecutive pixels to be printed run in a position where they are likely to be printed; and for printing each black pixel of the pattern which is followed by a white pixel of the pattern, forming one single drop of the first category and one single drop of the second category, wherein a time for forming one of said drops is less than a running time of one pixel, and a cumulative time for forming said single drops of the first and second categories is equal to or higher than a running time of one pixel.

16. The printer or printing head according to claim 15, wherein, for printing each black pixel of the pattern, the head is further configured to form one single drop of the first category and one single drop of the second category, the cumulative time for forming the single drop of the first category and the single drop of the second category being equal to a running time Dp of the medium by a distance Dii representing a distance between consecutive pixels in a direction of movement of the head.

17. The printer or printing head according to claim 15, wherein for forming each white pixel of the pattern, the head is further configured to form one single drop of the second category, the formation time thereof being at least equal to a running time Dp of the medium by a distance Dii representing a distance between consecutive pixels in a direction of movement of the head.

18. The printer or printing head according to claim 15, wherein the head is further configured to, before printing a current pixel of the pattern, determine whether a following pixel is a white or black pixel, and if the current pixel is black and the following pixel is white, to form a single drop of the first category for printing the current pixel, and then form a single drop of the second category, a formation time of said single drops of the first and second categories being at least equal to twice a running time of one pixel.

19. The printer or printing head according to claim 15, wherein for printing each succession of n consecutive black pixels of the pattern, n representing an integer equal to or higher than 2, the head is further configured to form drops of the first category being formed for a time equal to the running time of (n−1) black pixels plus a time between 1 and 2 times a formation time of one drop of the first category.

20. The printer or printing head according to claim 19, wherein a rate Vs is running rate selected so that a running time Dp of one pixel is equal to pda, p representing an integer and da representing the formation time of one drop of the first category.

21. The printer or printing head according to claim 15, wherein, for printing each black pixel of the pattern, the head is further configured to form one single drop of the first category and one single drop of the second category, a cumulative time for forming the single drop of the first category and the single drop of the second category being equal to a running time Dp of the medium by a distance Dii representing a distance between consecutive pixels in a direction of movement of the head, as long as a relative rate of the medium and the head, rate Vs, is lower than a value Vs0, or wherein, before printing a current pixel of the pattern, the head is further configured to determine whether a following pixel is a white or black pixel, and if the current pixel is black and the following pixel is white, to form a single drop of the first category for printing the current pixel, and then to form a single drop of the second category, a formation time of said simile drops of the first and second categories being at least equal to twice a running time of one pixel, as long as a relative rat of the medium and the head Vs is higher than a value Vs0.

22. The printer or printing head according to claim 21, wherein the value Vs0 is a rate for which Dp=Dii/Vs0 is equal to (1+Rm)da, in which formula Dp represents a running time by a distance Dii for the rate Vs0, Dii represents a distance between consecutive pixels in a direction of movement of the head, da represents a formation time of one drop of the first category, and Rm represents a minimum value which should be assumed by the ratio R of the volume of a drop of the second category to the volume of a drop of the first category so that the flowpaths of drops of the first and second categories are markedly differentiated in view of a separation mode of flowpaths.

23. The printer or printing head according to claim 15, wherein, when the running rate of the medium is higher than a threshold, positional information of the medium from medium position measuring means is substituted by information calculated from information received by said medium positioning measuring means.

24. The printer or printing head according to claim 23, wherein the substituted information is recalculated after each printing of entire pattern.

25. The printer or printing head according to claim 15, wherein, when the rate Vs is a running rate such that a running time Dp of one pixel is determined by taking a value between two integers times k and k+1, where k is a number of drops, of a formation time, da, of one drop of the first category, said formation time da is changed to a different formation time, da', such that the running time Dp is equal to k*da' or (k+1)*da'.

26. The printer or printing head according to claim 25, wherein, when the running rate Vs of the medium ranges between a first rate $Vs_k$ and a second rate $Vs_{k+1}$ for which the running time Dp is equal to kda and (k+1)da, respectively, and is equal to (k+z)da within the range of these two values, z being a number ranging from 0 to 1, the formation time of drops is increased as long as z is lower than a value $z_1$ and forming k drops having a formation time da'=da(k+$z_1$)/(k+1) per pixel is continued, and when z is equal to or higher than the value $z_1$, k+1 drops having a formation time da"=da(k+$z_1$)/(k+1) per pixel are formed.

27. The printer or printing head according to claim 15, wherein the formation time of drops is determined either by a time of a deviation between two consecutive pulses received by the actuators, or by an energy level of one pulse received by the actuators.

28. The printer or printing head according to claim 15, wherein differentiating the flowpaths followed by drops of the first and second categories respectively is achieved either by applying an electrostatic force to drops of the second category, or by applying to drops of the first and second categories a wind (W) with a direction transverse to the flowpath of the drops.

* * * * *